US005630399A

United States Patent [19]

Nomura et al.

[11] Patent Number: 5,630,399

[45] Date of Patent: May 20, 1997

[54] FUEL INJECTION SYSTEM WITH EMPLOYING VANE TYPE FUEL PUMP

[75] Inventors: Kenichi Nomura; Makoto Sakai, both of Yokohama, Japan

[73] Assignee: Keihin Seiki Mfg. Co., Ltd., Tokyo, Japan

[21] Appl. No.: 525,169

[22] Filed: Sep. 8, 1995

[30] Foreign Application Priority Data

Mar. 30, 1995 [JP] Japan ..... 7-097720

[51] Int. Cl.[6] ..... F02M 41/00; F04B 49/00

[52] U.S. Cl. ..... 123/467; 123/497; 417/308; 417/366

[58] Field of Search ..... 123/506, 467, 123/516, 179.17, 510, 497, 514; 417/308, 366

[56] References Cited

U.S. PATENT DOCUMENTS

| | | | |
|---|---|---|---|
| 4,400,139 | 8/1983 | Masuda | 417/308 |
| 4,920,942 | 5/1990 | Fujimuri | 123/497 |
| 5,039,284 | 8/1991 | Talaski | 417/366 |
| 5,120,201 | 6/1992 | Tuckey | 417/366 |
| 5,131,822 | 7/1992 | Yamamoto | 417/366 |
| 5,148,792 | 9/1992 | Tuckey | 123/514 |
| 5,339,785 | 8/1994 | Wilksch | 123/467 |
| 5,361,742 | 11/1994 | Briggs | 123/506 |
| 5,406,922 | 4/1995 | Tuckey | 123/497 |
| 5,477,829 | 12/1995 | Hassinger | 123/467 |
| 5,478,213 | 12/1995 | Harris | 413/308 |

*Primary Examiner*—Carl S. Miller

*Attorney, Agent, or Firm*—Cushman Darby & Cushman, L.L.P.

[57] ABSTRACT

A fuel injection system includes a vane-type fuel pump. The fuel pump has a first bypass passage with a first pressure relief valve for relieving pressurized fuel from a discharge passage downstream of a check valve to the discharge passage upstream of the check valve so that excess pressure in the discharge passage downstream of the check valve can be relieved to the discharge pressure upstream of the check valve. Therefore, fuel leakage through a fuel injection valve can be prevented for avoiding possibility of formation of overrich mixture even upon hot start condition.

4 Claims, 3 Drawing Sheets

FUEL INJECTION SYSTEM WITH EMPLOYING VANE TYPE FUEL PUMP

BACKGROUND OF THE INVENTION

1. Field of the Invention

The present invention relates generally to a fuel injection system, in which a fuel in a fuel tank is pressurized and supplied to a fuel delivery pipe by a fuel pump and is injected to an induction system of an internal combustion engine, by means of a fuel injection valve provided in the fuel delivery pipe. More specifically, the invention relates to a fuel injection system employing a vane type fuel pump, in which an inner rotor is eccentrically arranged within an internal bore of a housing in rotatable fashion, rollers are kept in contact with the inner periphery of the internal bore of the housing and radially moved in back-and-forth according to rotation of the inner rotor to perform suction and discharge of the fuel in the duel tank, and a pump speed of the fuel pump is controlled depending upon an electric signal from an electric control unit receiving an electric signal from a pressure sensor detecting a fuel pressure in the fuel delivery pipe and electric signals from various sensors detecting an engine operating condition.

2. Description of the Related Art

The vane type fuel pump of the type set forth above is frequently employed in a fuel injection system. As is known in the art, such vane type fuel pump may have higher discharge pressure than a Wesco-type fuel pump. Therefore, the vane type fuel pump is frequently employed in the fuel injection system which injects fuel directly into combustion chambers of the internal combustion engine.

FIG. 3 shows a fuel injection system employing a conventional vane type fuel pump. In FIG. 3, the reference numeral 30 denotes a vane-type fuel pump assembly. The vane-type fuel pump assembly 30 includes a motor portion M which has an output shaft 31, an armature 32 and commutator 33 mounted on the output shaft 31, a brush assembly 34 contacting with the commutator 33, and a pair of permanent magnets 36 arranged within a casing 35 in opposition to the armature 32. Upper and lower portions of the output shaft 31 are rotatably supported by bearing members 37. P denotes a pump portion of the vane-type fuel pump assembly 30, which includes an inner rotor driven to rotate by the output shaft 31 of the motor portion M, rollers driven to move in back-and-forth in radial direction of the inner roller with keeping contact with the inner periphery of the internal bore of the housing, a suction side cover covering one end surface of the housing and formed with a suction port, and a discharge side cover covering the other end surface of the housing and formed with a discharge port (which detailed structure is not shown in the drawings). These motor portion M and the pump portion P are housed within a casing 35. Then, a fuel suction passage 38 communicated with the suction port of the pump portion P opens to the one end of the casing 35, and is connected to the fuel tank 7 storing a fuel. A fuel discharge passage 39 opening to the other end of the casing 35 via the outer circumference of the motor portion M is connected to a fuel delivery pipe D, to which one or more fuel injection valves J are provided.

It should be noted that the reference numeral 40 denotes a check valve arranged within the fuel discharge passage 39, which performs only fuel flow from the fuel discharge passage 39 into the fuel delivery pipe D for blocking surge flow of the fuel. The reference numeral 41 denotes a bypass passage communicating of the portion of the fuel discharge passage 39 located at the upstream side to the check valve 40 to the fuel suction passage 38, bypassing the pump portion P. Within the bypass passage 41, a normally closed pressure relief valve 42 which establish fuel communication through the bypass passage 41 when the fuel pressure within the fuel discharge passage 39 upstream side of the check valve 40 is elevated to be higher than or equal to a given pressure. The reference numeral 43 denotes an electronic control unit (hereinafter referred to as "ECU") receiving an electric signal from a pressure sensor 44 detecting a fuel pressure in the fuel delivery pipe D and electric signals from various sensors 45 detecting the engine operating condition, and outputs an electric control signal to the brush assembly 34 of the motor portion M.

With the construction as set forth above, the motor portion M is driven for revolution by application of the electric control signal from the ECU 43 to the commutator 33 via the brush assembly 34. The revolution of the commutator is then transmitted to the pump portion P via the output shaft 31 of the motor portion M. Thus, the inner rotor of the pump portion P is driven to rotate to cause back-and-forth movement of the rollers housed in radial recesses of the inner rotor to cause variation of the pump chamber to such the fuel stored in the fuel tank T into the pump portion via the fuel suction passage 38 and pressurized to be circulated into the fuel discharge passage 39. On the other hand, the pressurized fuel fed into the fuel discharge passage 39 is supplied into the duel delivery pipe D with opening the check valve 40, and then injected into the induction system or the combustion chamber of the internal combustion engine through the fuel injection valve J.

When the fuel pressure in the fuel delivery pipe D is lower than a predetermined desired fuel pressure, the pressure sensor 44 detects the lower pressure condition to feed an electric signal indicative of the low pressure state to the ECU 43. Then, the ECU 43 is responsive to the low fuel pressure indicative electric signal from the pressure sensor 44 to output the electric control signal for increasing motor speed of the motor portion M to the brush assembly 34 of the motor portion M. By the process set forth above, the pressurized fuel with the elevated pressure is supplied to the fuel delivery pipe D from the pump portion D. Thus, the fuel pressure in the fuel delivery pipe D is elevated to the desired pressure level.

On the other hand, when the fuel pressure in the fuel delivery pipe D is higher than the predetermined desired fuel pressure, the pressure sensor 44 detects the higher pressure condition to output the electric signal indicative of the higher pressure state to the ECU 43. Thus, the ECU 43 issues the electric control signal for decelerating the motor speed of the motor portion M and where by for lowering the discharge pressure in the pump portion P. Thus, the motor speed of the motor portion M is lowered to supply the fuel at the lowered pressure and whereby to lower the fuel pressure within the fuel delivery pipe D to the desired pressure level.

Namely, with the shown arrangement, the fuel pressure in the fuel delivery pipe D is appropriately controlled by controlling the motor speed of the motor portion M on the basis of the electric signal from the pressure sensor 44, and whereby is maintained at the desired fuel pressure level.

It should be noted the pressure relief valve 42 arranged in the bypass passage 41 is desired to relief the excess fuel pressure in the bypass passage 41 to the fuel suction passage 38 when the fuel pressure at the fuel discharge passage 39 at the portion upstream of the check valve 40 above the pressure higher than the given pressure.

With the fuel injection system employing the conventional vane-type fuel pump, in the engine resting condition after driving, the check valve 40 automatically blocks the fuel discharge passage 39, the fuel within the fuel discharge passage 39 downstream of the check valve 40 and the fuel delivery pipe D are maintained in the enclosed fuel delivery circuit.

On the other hand, in such engine resting condition after driving, the environmental temperature of the engine is high. Particularly, the fuel delivery pipe D and the fuel discharge passage 39 are located in the vicinity of the engine to be exposed to the high temperature condition. Therefore, the temperature of the fuel in the fuel delivery pipe D and the fuel discharge passage 39 downstream of the check valve 40 is elevated. As set forth above, since the fuel pressure in the fuel delivery pipe D and the fuel discharge passage 39 is elevated, it is possible to cause leakage of the fuel through the fuel injection valve J to the engine. Therefore, upon restarting of the engine (hot-start condition), an air/fuel mixture becomes excessively rich to degrade performance of re-starting of the engine. On the other hand, a needle valve arranged in the fuel injection valve is depressed onto a valve seat with an excessive depression force by the elevated fuel pressure. Therefore, upon re-starting of the engine, the response characteristics in opening of the needle valve of the fuel injection valve can be degraded. Furthermore, the fuel delivery pipe D and the fuel discharge passage at the portion downstream of the check valve are required substantial withstanding pressure for bearing the elevated fuel pressure. In addition, since the check valve is also subject elevated fuel pressure to receive excessive depression force for seating onto a valve seat to cause degradation of response characteristics in opening the check valve. Also, the check valve is inherently required substantial mechanical strength for bearing such elevated fuel pressure.

SUMMARY OF THE INVENTION

In view of the problems as set forth above, it is an object of the present invention to avoid elevating of the fuel pressure stored in an enclosed fuel delivery circuit constituted of a fuel delivery pipe and a portion of a fuel discharge passage downstream of a check valve beyond a given fuel pressure, to avoid formation of excessively right air/fuel mixture upon hot-start of the engine, to improve response characteristics of a fuel injection valve and the check valve, and to improve pressure withstanding of the fuel delivery pipe, a casing, a fuel discharge passage and so forth.

According to one aspect of the invention, a fuel injection system employing a vane-type fuel pump, in which a fuel in a fuel tank is supplied to a fuel delivery pipe under pressure by means of the vane-type fuel pump and is injected toward engine through a fuel injection valve connected to the fuel delivery pipe, the vane-type fuel pump being controlled a pump speed by an electric control signal from an electronic control unit depending upon an electric signal from a pressure sensor detecting a fuel pressure in the fuel delivery pipe and electric signals from various sensors detecting engine operating parameters, the vane-type fuel pump comprises:

a casing;

a vane type pump portion;

a motor portion rotatingly driving the pump portion;

a fuel suction passage communicated with a suction port of the pump portion and opening to one end of the casing;

a fuel discharge passage communicated with a discharge port of the pump portion and opening to the other end of the casing via the outer periphery of the motor portion;

a check valve disposed in the fuel discharging passage and permitting only fuel flow directed in a discharge direction;

a normally closed first relief valve arranged in a first bypass passage communicating the fuel discharge passage upstream of the check valve and the fuel discharge passage downstream of the check valve bypassing the check valve, for opening the first bypass passage when a fuel pressure in the fuel discharge passage downstream of the check valve is elevated to be higher than or equal to a given pressure level; and a normally closed second relief valve disposed within a second bypass passage communicating the fuel suction passage and the fuel discharge passage upstream of the check valve, for opening the second bypass passage when a fuel pressure in the fuel discharge passage upstream of the check valve 24 elevated to be higher than or equal to a given pressure.

According to another aspect of the invention, a fuel pump structure for a fuel injection system comprises:

a casing housing therein a motor portion and a pump portion driven by the motor portion;

a suction passage communicating a fuel tank and the pump portion for supplying a fuel into the pump portion;

a discharge passage communication the pump portion and a fuel injection valve of the fuel injection system for feeding a pressurized fuel to the fuel injection valve;

an one-way check valve disposed in the discharge passage for preventing surge flow of a fuel;

a first bypass passage communicating the pump portion and the fuel injection valve bypassing the one-way check valve;

a second bypass passage communication the suction passage and the discharge passage bypassing the pump portion;

a first pressure relief valve responsive to a fuel pressure in the discharge passage downstream of the one-way check valve for normally blocking fuel communication through the first bypass passage while the fuel pressure in the discharge passage downstream of the one-way check valve is maintained to be lower than a first set pressure, and establishing fuel communication through the first bypass passage for recirculating fuel to the discharge pressure upstream of the one-way check valve when the fuel pressure in the discharge passage downstream of the one-way check valve is elevated across the first set pressure; and a second pressure relief valve responsive to a fuel pressure in the discharge passage upstream of the one-way check valve for normally blocking fuel communication through the second bypass passage while the fuel pressure in the discharge passage upstream of the one-way check valve is maintained to be lower than a second set pressure, and establishing fuel communication through the second bypass passage for recirculating fuel from the discharge passage upstream of the one-way check valve to the suction passage when the fuel pressure in the discharge passage upstream of the one-way check valve is elevated across the second set pressure. The first set pressure of the first pressure relief valve may be smaller than the second set pressure of the second pressure relief valve.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiment of a fuel injection system employing a vane-type fuel pump according to the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
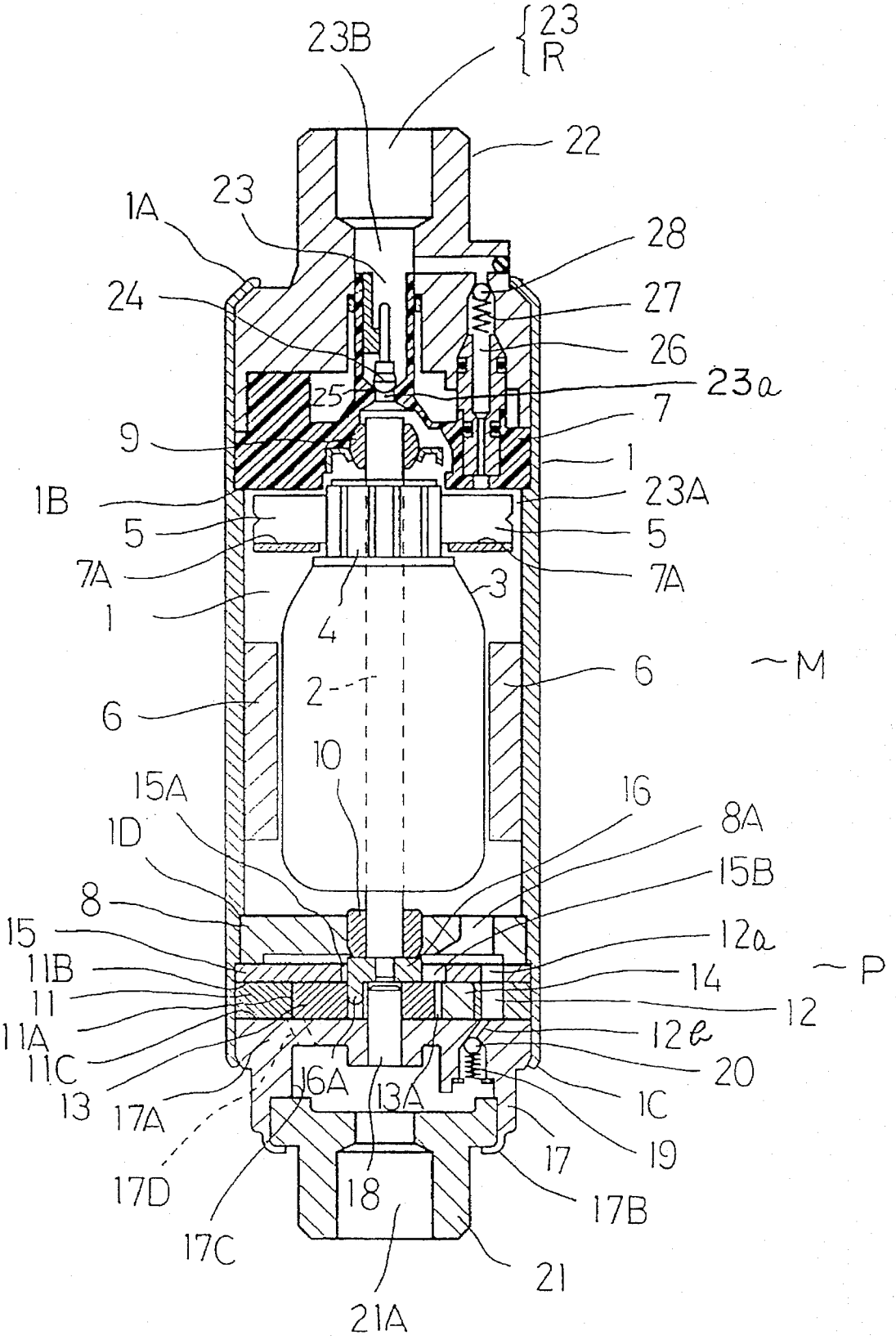
FIG. 1 is a section showing the preferred embodiment of a vane-type fuel pump according to the present invention.

Referring now to FIG. 1, the preferred embodiment of a vane-type fuel pump to be employed in the preferred embodiment of a fuel injection system will be discussed.

In FIG. 1, the reference numeral 1 denotes a casing, in which a motor portion M and a pump portion P are housed. The motor portion M includes an output shaft 2, an armature 3 and a commutator 4 mounted on the output shaft 2, a brush assembly 5 contacting with the commutator 4, and a pair of permanent magnets 6 arranged within the casing 1 in opposition to the armature 3. On a first engaging step portion 1B opposing to one end 1A of the casing 1, a terminal holder 7 is arranged. On the other hand, on a second engaging step portion 1D opposing to the other end 1C of the casing 1, a bearing holder 8 is arranged. The output shaft 2 of the motor portion M is rotatably supported on a first bearing portion 9 arranged at the center portion of the terminal holder 7 in the vicinity of one end thereof. The output shaft 2 is also rotatably supported on a second bearing portion 10 arranged at the center portion of the bearing holder 8 in the vicinity of the other end thereof. On the other hand, the brush assembly 5 is disposed within a brush receptacle bore 7A of the terminal holder 7. The brush assembly 5 is resiliently biased toward the commutator 4 for maintaining contact. It should be noted that a fluid passage 8A is formed through the side portion of the bearing holder 8.

The pump portion P includes a housing 11 formed with a cross-sectionally circular shaped internal bore 11A. A second bypass passage 12 is defined through the side wall portion of the internal bore 11A. Within the internal bore 11A, a cross-sectionally circular shaped inner rotor 13 is rotatably disposed in eccentric fashion relative to the internal bore 11A. On the periphery of the inner rotor 13, a plurality of radially extending recesses 13A opening to the outer peripheral surface are formed. Within each radially extending recesses 13A, a cylindrical roller 14 is arranged for reciprocal movement in back-and-forth, in radial direction. The reference numeral 15 denotes a side cover at the discharge side arranged on one side surface 11B of the housing 11. At the center portion of the side cover 15 at the discharge side, a clearance hole 15A permitting rotation of a rotation transmitting member 16 integrally arranged at the lower end of the output shaft 2, a discharge hole 15B corresponding to the internal bore of the housing and a second bypass passage 12*a* are formed. The rotation transmitting member 16 synchronously rotates with the output shaft 2. The rotation transmitting member 16 carries a pin 16A extending downwardly which is inserted within the inner rotor 13 to transmit rotation of the outer shaft 2 to the inner rotor 13.

The reference numeral 17 denotes a side cover at a suction side arranged above the other end surface 11C of the housing 11. The side cover 17 has a bottom portion 17A and an inner peripheral surface 17C directed from the bottom portion 17A to the lower opening 17B. In the bottom portion 17A, a rotor shaft 18 is extended upwardly and placed at the other end 11C of the housing 11. The axis of the rotor shaft 18 is slightly offset from the center axis of the output shaft 2. On the other hand, in the bottom portion 17A, a suction bore 17D corresponding to the internal bore 11A of the housing 11 is formed Also, a second bypass passage 12*b* communicated with the second bypass passage 12 is formed through the bottom portion 17A. In the second bypass passage 12*b* of the side cover 17 at the suction side, a second pressure relief valve 20 is provided. The second pressure relief valve 20 is biased by a spring 19 for normally closing the second bypass passage 12*b*. The reference numeral 21 denotes a first pipe adapter engaged on the inner peripheral surface 17C of the side cover 17 at the suction side. To the first pipe adapter 21, a fuel suction passage 21A is formed.

Each component of the pump portion P is arranged on the bearing holder 8 within the casing 1. Namely, on the lower end of the bearing holder 8, a housing having a side cover 15 at the suction side, the rollers 14 and the inner rotor 13, the side cover 17 at the suction side, and the first pipe adapter 21 are arranged in order. The other end of the casing 1C of the casing 1 is inwardly clamped with respect to the outer periphery of the side cover 17 at the suction side. On the other hand, the lower opening 17B of the side cover 17 at the suction side is inwardly clamped with respect to the first pipe adapter 21.

With the construction set forth above, the inner rotor 13 is rotatably supported by a rotary shaft 18. The axis of the inner rotor 13 is slightly offset from the center axis of the internal bore 11A of the housing 11. Also, within the inner rotor 13, the pin 16A of the rotation transmitting member 16 is inserted to transmit the rotation of the output shaft 2 of the motor portion M to the inner rotor 13. On the other hand, the second bypass passage 15*a* formed through the side cover 15 at the discharge side, the second bypass passage 12 formed through the housing 11, the second bypass passage 12*b* formed through the side cover 17 at the suction side are communicated with each other to form an integrated second bypass passage. The upstream side of the second bypass passage opens to the fuel suction passage 21A, and the downstream side of the second bypass passage opens to a flow passage 8A of the bearing holder 8. (It should be noted that the upstream side and the downstream side are defined with respect to the flow direction of the fuel throughout the disclosure and claims).

The reference numeral 22 denotes a second pipe adapter arranged at the one end 1A of the casing 1 above the terminal holder 7. A fuel discharge passage 23 is formed through the center portion of the second pipe adapter 22. The fuel discharge passage 23 is communicated with a fuel discharge passage 23*a* formed through the terminal holder 7. The reference numeral 24 denotes a check valve adapted to be seated on a valve seat 25 formed in the fuel discharge passage 23*a* of the terminal holder 7. The check valve 24 is adapted to be released away from the valve seat 25 by a flow of the fuel directed from the upstream side to the downstream side, and is seated on the valve seat 25 to block fluid communication through the second bypass passage 23*a* in response to the fuel flow from the downstream side to the upstream side. The reference numeral 26 denotes a first bypass passage communicating an upstream side fuel discharge passage 23A and a downstream side fuel discharge passage 23B by passing the valve seat 25. In the first bypass passage 26, a first pressure relief valve 28 is provided. The first pressure relief valve 28 blocks flow of the fuel directed from the fuel discharge passage 23A at the upstream side to the fuel discharge passage 23B at the downstream side by constantly depressed by a spring 27.

Namely, the above-mentioned vane-type fuel pump has the motor portion M and the pump portion P housed within the casing 1. The side cover 17 at the suction side located at the upstream side of the pump portion P and the pipe adapter 21 form a fuel suction passage 21A. On the other hand, at the downstream of the pump portion P, the fuel discharge passage R is formed with the flow passage 8A of the bearing holder 8, the fuel discharge passage 1E defined by the inner periphery of the casing 1 and the outer periphery of the motor portion M, the fuel discharge passage 23*b* formed through the terminal holder 7 and the fuel discharge passage 23 formed through the second pipe adapter 22. On the other hand, within the second bypass passage 12 communicating the fuel suction passage 21A and the fuel discharge passage 23A upstream of the check valve 24 (in other words, the fuel discharge passage 1E defined between the inner periphery of the casing 1 and the outer periphery of the motor portion M) bypassing the pump portion P, a normally closed second pressure relief valve 20 is arranged for opening the second bypass passage 12 when the fuel pressure within the fuel discharge passage 23A upstream of the check valve 24 is built higher than or equal to a given pressure. In addition, within the first bypass passage 26 communicating the fuel discharge passage 23A at the upstream side and the fuel discharge passage 23B at the downstream side by passing the check valve 24 and, in other words, bypassing the valve seat 25, the normally closed first pressure relief valve 28 is arranged for opening the first bypass passage 26 when the fuel pressure within the fuel discharge passage 23B at the downstream side is built to be higher than or equal to a given pressure.

Figure 2:
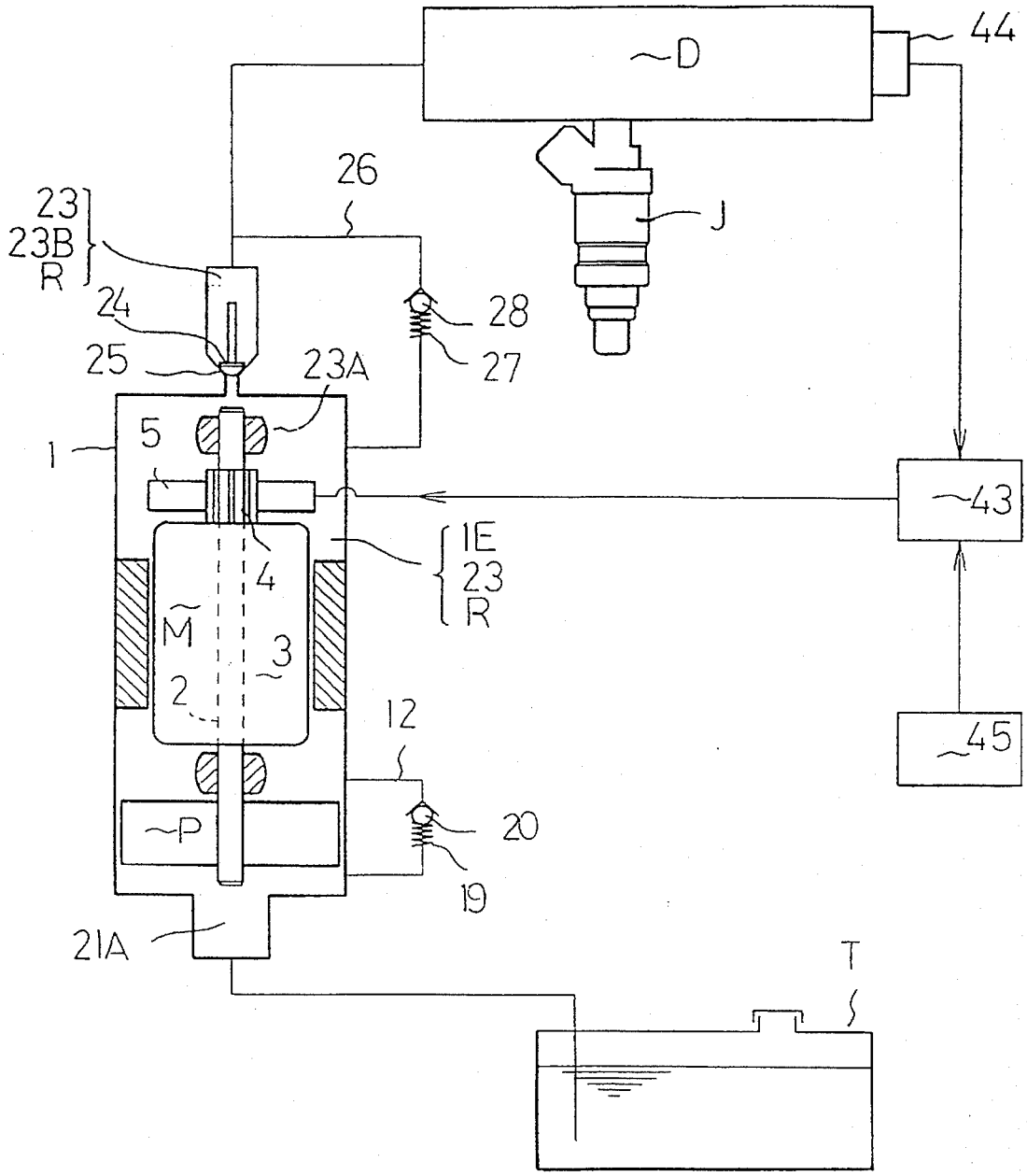
FIG. 2 is a diagrammatic illustration showing a fuel injection system for an automotive internal combustion engine, in which the preferred embodiment of the vane-type fuel pump of FIG. 1 is applied.
Figure 3:
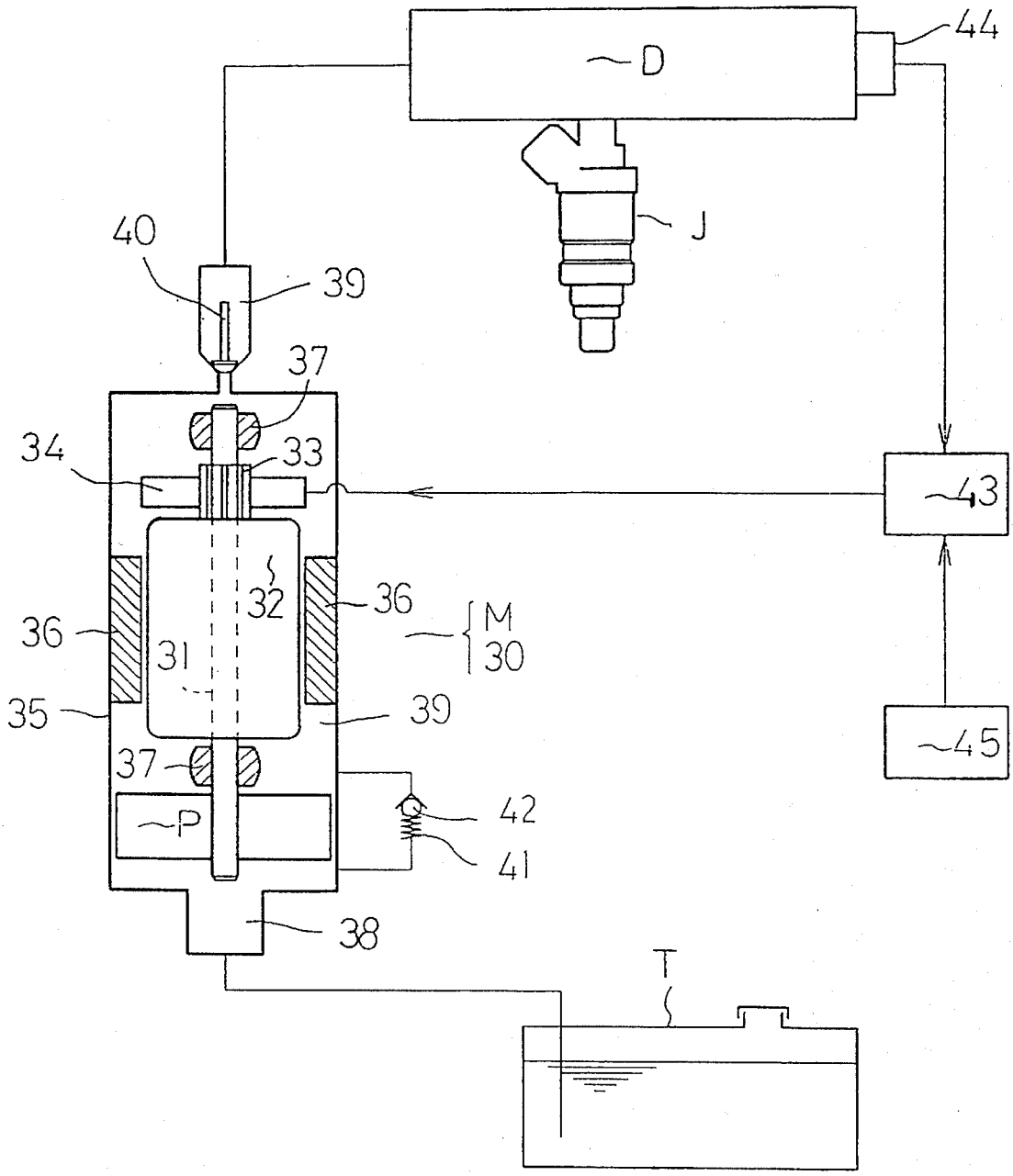
FIG. 3 is a similar view to FIG. 2 but showing the fuel injection system employing the conventional vane-type fuel pump.

Then, the fuel suction passage 21A of the vane-type fuel pump is communicated with the interior space of the fuel tank 7 for feeding the fuel therein. On the other hand, the fuel discharge passage 23 (the fuel discharge passage 23 downstream of the check valve 24) is connected to the fuel delivery pipe D. The connecting condition is illustrated in FIG. 2. In FIG. 2, like elements of the fuel injection system to those of FIG. 3 as set forth above will be represented by the like reference numerals. Since the common elements to the conventional system perform substantially the same function to those in the conventional system, detailed description therefor is neglected for maintaining disclosure simple enough and thus for facilitating clear understanding of the invention.

Next, discussion will be given for operation.

The electric control signal output from the ECU 43 is applied to the commutator 4 via the brush assembly 5, the output shaft 2 of the motor portion M is driven to rotate by revolution of the motor portion. Then, the rotational torque on the output shaft 2 is transmitted to the inner rotor 13 via the pin 16A of the rotation transmitting member 16. By rotation of the inner rotor 13, pumping operation is performed in per se known manner. Then, the fuel in the fuel tank T is sucked into a pump chamber defined by the internal bore 11A of the housing 1, the outer periphery of the inner rotor 13 and the rollers 14 via the fuel suction passage 21A and the suction port 17D. Then, from the pump chamber, the fuel is discharged under pressure into the fuel discharge passage 1E defined between the inner periphery of the casing 1 and the outer periphery of the motor portion M via the discharge port 15B. The pressurized fuel fed into the fuel discharge passage 1E opens the check valve 24 by the fuel pressure, is fed to the fuel delivery pipe D via the fuel discharge passage 23A at the upstream side, the valve seat 25, the fuel discharge passage 23B at the downstream side. On the other hand, the pressurized fuel in the fuel delivery pipe D is injected into the induction system or directly into the combustion chamber of the engine through the fuel injection valve according to an electric fuel injection signal output from the ECU 43. Thus, the engine is driven.

In the operating condition of the engine determined by the fuel pressure in the fuel delivery pipe D, if the fuel pressure is lower than the predetermined desired fuel pressure at a given engine operating condition, the engine operating condition is detected by various sensors 45, such as a throttle angle sensor detecting a throttle valve open angle, an engine speed sensor detecting revolution speed of the engine, an intake air sensor detecting an intake air flow rate introduced into the induction system of the engine and so forth. These sensors 45 respective outputs electric sensor signals to the ECU 43. Also, the pressure sensor 44 detects the fuel delivery pipe D. At the shown state, lower pressure condition of the fuel pressure in the fuel delivery pipe D is detected by the pressure sensor 44 and the lower pressure indicative electric pressure sensor signal is output to the ECU 43. The ECU 43 is responsive to the lower pressure indicative electric pressure sensor signal to output the electric control signal to the brush assembly 5 of the motor portion M to increase the revolution speed of the motor portion M. Thus, the pump portion P is driven at the increased revolution speed of the motor portion M to increase the elevated discharge pressure to feed the desired pressure level of the fuel to the fuel delivery pipe D. On the other hand, under the given operating condition, if the fuel pressure in the fuel delivery pipe D as detected by the pressure sensor 44 is higher than the predetermined desired pressure level corresponding to the given engine operating condition, the pressure sensor 44 outputs the higher pressure indicative electric pressure sensor signal. Them, the ECU 43 is responsive to the higher pressure indicative electric pressure sensor signal to output the electric control signal to lower the revolution speed of the motor portion M. Thus, the pump portion P is driven at the lowered revolution speed of the motor M to lower the fuel pressure to be fed to the fuel delivery pipe D. Therefore, the desired pressure level of the fuel is supplied to the fuel delivery pipe D.

In the shown embodiment, the fuel pressure discharged from the pump portion P is 4.2 kg/cm$^2$ at a voltage 14 V and fuel temperature 25° C. At this condition, the first relief valve 28 is provided a set pressure by the spring 27 so as to open the first bypass passage 26 when the fuel pressure of the fuel discharge passage 23B at the downstream side of the check valve 24 is elevated to be higher than or equal to 1.4 kg/cm$^2$. On the other hand, the second relief valve 20 is provided a set pressure by the spring 19 so as to open the second bypass passage 12 when the fuel pressure in the fuel discharge passage 23A at the upstream of the check valve 24 (in other words, the fuel discharge passage 1E defined between the inner periphery of the casing 1 and the outer periphery of the motor portion M at the upstream side of the check valve 24) is elevated higher than or equal to 5 kg/cm$^2$.

Accordingly, in the second bypass passage 12, even when the pressure in the fuel discharge passage 23A upstream of the check valve 24 is elevated higher than or equal to the 4.2 kg/cm$^2$, the second relief valve 20 does not open the second bypass passage 12. Therefore, even at this condition, the pump portion P maintains appropriate pump discharging operation. On the other hand, in the first bypass passage 26, since the fuel pressure to equalize the pressure level between the fuel discharge passage 23A at the upstream side of the first relief valve 28 and the fuel discharge passage at the downstream side of the first relief valve 28, the first bypass passage 26 is certainly maintained in the closed condition by the spring force of the spring 27 by during pump operating condition.

In the preferred embodiment of the vane-type fuel pump, the second relief valve 20 operated in the following manner. At first, under the engine operating condition, when the motor portion M is abnormally accelerated to the abnormally high revolution speed, when the check valve 24 steaks on the valve seat 25 and cannot be opened, the fuel injection valve J causes failure to be inoperative so that the needle valve of the fuel injection valve cannot open the valve bore, or a part of the fuel discharge passage 23 is plugged by impurity, the fuel pressure in the fuel discharge passage 23 and/or the fuel delivery pipe D can be built to be higher than the 4.2 kg/cm$^2$ of the normal discharge pressure. Here, in the present invention, when the fuel pressure is elevated as set forth above, the second relieve valve 20 opens the second bypass passage 12 against the spring force of the spring 29 to drain the elevated fuel pressure in the fuel discharge passage 23 and/or the fuel delivery pipe D to the fuel suction passage 21A. Thus, since the significantly elevating of the fuel pressure in the fuel delivery pipe D and the fuel discharge passage 23 can be successfully suppressed, it becomes unlikely to cause damaging of the fuel delivery pipe D, the fuel discharge passage 23 and the casing 1, and to cause leakage of the fuel through the connecting portion. On the other hand, at the resting condition of the engine, particularly, when the casing of the vane-type fuel pump is warmed at the engine environmental temperature, the fuel discharge passage 1E of the casing 1 is warmed to cause elevation of the fuel pressure in the casing 1. In such condition, similarly to the above, the second relief valve 20 opens the second bypass passage 12 to restrict elevation of the fuel pressure in the casing 1.

Next, discussion is given for the operation of the first relief valve 28.

Namely, at the resting condition of the engine, the needle valve of the fuel injection valve J is closed, and the check valve 24 is seated on the valve seat 24 for blocking the fuel discharge passage 23. Then, the enclosed chamber or enclosed fuel delivery circuit including the fuel delivery pipe D with the fuel discharge passage 23B at the downstream of the check valve, is established. At this condition, since the fuel delivery pipe D is located in the vicinity of the engine and thus is influenced by the heat generated by the engine to be warmed/ Thus, the fuel pressure is elevated by the elevated fuel temperature in the fuel delivery pipe D. However, since the shown embodiment of the vane-type fuel pump is provided the first bypass passage 26 with the first relieve valve 28 bypassing the check valve 24, the elevated fuel pressure in the fuel delivery pipe D instantly pushed the check valve 24 to open the first bypass passage 26. By this, the elevated fuel pressure is permitted to leak into the fuel discharge passage 23A at the upstream side of the check valve 24. Therefore, elevation of the fuel pressure in the fuel delivery pipe D can be suppressed. As set forth, since leakage of the fuel to the engine through the fuel injection valve J can be avoided, over-rich condition of air/fuel mixture to be introduced into the engine combustion chamber upon hot start condition of the engine can be successfully prevented. Therefore, start-up characteristics of the engine can be significantly improved.

Also, since the needle valve of the fuel injection valve J may not be subject to excessively elevated high fuel pressure, a response characteristics of operation of the fuel injection valve cannot be degraded. This also contributes improvement of the engine start-up characteristics.

Furthermore, with the construction as set forth above, since the check valve 24 is not depressed onto the valve seat with excessively large depression force, the check valve 24 may not be stack on the valve seat 25. Upon restarting of the engine, especially in hot start condition, since the check valve 24 may be released from the valve seat 25 by the fuel flow in the fuel discharge passage 1E, good restarting characteristics of the engine can be attained. In particular, the valve portion of the check valve 24 contacting on the valve seat 25 is formed with employing a rubber material for improving sealing ability. Therefore, avoidance of exertion of the excessive fuel pressure to the check valve is quite effective for improving durability of the check valve. In this case, the elevated fuel pressure in the fuel delivery pipe D is recirculated into the fuel discharge passage 23A upstream of the check valve 24 through the first bypass passage 26. However, since the amount of fuel leaking and recirculating into the fuel discharge passage 23A is quite small and performed gradually, the amount of fuel corresponding to the recirculation amount can leak into the fuel suction passage 21A via the pump portion P. In particular, in the first relief valve 28, the fuel pressure in the fuel discharge passage equalized at the upstream side and the downstream side of the first relief valve 28 cancels the opening and closing operation force for the first relief valve, the spring force of the spring 27 can be set quite small. By this, fuel pressure in the fuel delivery pipe D can be relieved even when the fuel pressure is slightly exceeded.

As set forth above, according to the present invention, a fuel injection system employing a vane-type fuel pump, in which a fuel in a fuel tank is supplied to a fuel delivery pipe under pressure by means of the vane-type fuel pump and is injected toward engine through a fuel injection valve connected to the fuel delivery pipe, the vane-type fuel pump being controlled a pump speed by an electric control signal from an electronic control unit depending upon an electric signal from a pressure sensor detecting a fuel pressure in the fuel delivery pipe and electric signals from various sensors detecting engine operating parameters, the vane-type fuel pump comprises a casing, a vane type pump portion, a motor portion rotatingly driving the pump portion, a fuel suction passage communicated with a suction port of the pump portion and opening to one end of the casing, a fuel discharge passage communicated with a discharge port of the pump portion and opening to the other end of the casing via the outer periphery of the motor portion, a check valve disposed in the fuel discharging passage and permitting only fuel flow directed in a discharge direction, a normally closed first relief valve arranged in a first bypass passage communicating the fuel discharge passage upstream of the check valve and the fuel discharge passage downstream of the check valve bypassing the check valve, for opening the first bypass passage when a fuel pressure in the fuel discharge passage downstream of the check valve is elevated to be higher than or equal to a given pressure level, and a normally closed second relief valve disposed within a second bypass passage communicating the fuel suction passage and the fuel discharge passage upstream of the check valve, for opening the second bypass passage when a fuel pressure in the fuel discharge passage upstream of the check valve 24 elevated to be higher than or equal to a given pressure, and therefore, since leakage of the fuel to the engine through the fuel injection valve J can be avoided, over-rich condition of air/fuel mixture to be introduced into the engine combustion chamber upon hot start condition of the engine can be successfully prevented. Therefore, startup characteristics of the engine can be significantly improved.

Also, since excessive fuel pressure will never been exerted on the check valve as well as the fuel injection valve, durability of the components of the fuel delivery system for the fuel injection system can be significantly improved.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A fuel injection system employing a vane-type fuel pump, in which a fuel in a fuel tank is supplied to a fuel delivery pipe under pressure by means of said vane-type fuel pump and is injected toward engine through a fuel injection valve connected to said fuel delivery pipe, said vane-type fuel pump being controlled a pump speed by an electric control signal from an electronic control unit depending upon an electric signal from a pressure sensor detecting a fuel pressure in said fuel delivery pipe and electric signals from various sensors detecting engine operating parameters, said vane-type fuel pump comprising:

a casing;

a vane type pump portion;

a motor portion rotatingly driving said pump portion;

a fuel suction passage communicated with a suction port of said pump portion and opening to one end of said casing;

a fuel discharge passage communicated with a discharge port of said pump portion and opening to the other end of said casing via the outer periphery of said motor portion;

a check valve disposed in said fuel discharging passage and permitting only fuel flow directed in a discharge direction;

a normally closed first relief valve arranged in a first bypass passage communicating said fuel discharge passage upstream of said check valve and said fuel discharge passage downstream of said check valve bypassing said check valve, for opening said first bypass passage when a fuel pressure in said fuel discharge passage downstream of said check valve is elevated to be higher than or equal to a given pressure level; and a normally closed second relief valve disposed within a second bypass passage communicating said fuel suction passage and said fuel discharge passage upstream of said check valve, for opening said second bypass passage when a fuel pressure in said fuel discharge passage upstream of said check valve (24) is elevated to be higher than or equal to a given pressure.

2. A fuel pump structure for a fuel injection system comprising:

a casing housing therein a motor portion and a pump portion driven by said motor portion;

a suction passage communicating a fuel tank and said pump portion for supplying a fuel into said pump portion;

a discharge passage communication said pump portion and a fuel injection valve of said fuel injection system for feeding a pressurized fuel to said fuel injection valve;

an one-way check valve disposed in said discharge passage for preventing surge flow of a fuel;

a first bypass passage communicating said pump portion and said fuel injection valve bypassing said one-way check valve;

a second bypass passage communication said suction passage and said discharge passage bypassing said pump portion;

a first pressure relief valve responsive to a fuel pressure in said discharge passage downstream of said one-way check valve for normally blocking fuel communication through said first bypass passage while said fuel pressure in said discharge passage downstream of said one-way check valve is maintained to be lower than a first set pressure, and establishing fuel communication through said first bypass passage for recirculating fuel to said discharge pressure upstream of said one-way check valve when said fuel pressure in said discharge passage downstream of said one-way check valve is elevated across said first set pressure; and a second pressure relief valve responsive to a fuel pressure in said discharge passage upstream of said one-way check valve for normally blocking fuel communication through said second bypass passage while said fuel pressure in said discharge passage upstream of said one-way check valve is maintained to be lower than a second set pressure, and establishing fuel communication through said second bypass passage for recirculating fuel from said discharge passage upstream of said one-way check valve to said suction passage when said fuel pressure in said discharge passage upstream of said one-way check valve is elevated across said second set pressure.

3. A fuel pump as set forth in claim 2, wherein said pump portion has a vane-type pump structure.

4. A fuel pump as set forth in claim 3, wherein said first set pressure of said first pressure relief valve is smaller than said second set pressure of said second pressure relief valve.

* * * * *